US009252498B2

(12) United States Patent
Lee

(10) Patent No.: US 9,252,498 B2
(45) Date of Patent: Feb. 2, 2016

(54) N PORT FEEDING SYSTEM USING A SLOW WAVE STRUCTURE FEEDING DEVICE INCLUDED IN THE SAME

(75) Inventor: Seung-Cheol Lee, Incheon-si (KR)

(73) Assignee: ACE TECHNOLOGIES CORPORATION, Incheon-si (KR)

( * ) Notice: Subject to any disclaimer, the term of this patent is extended or adjusted under 35 U.S.C. 154(b) by 358 days.

(21) Appl. No.: 13/508,965

(22) PCT Filed: Nov. 22, 2010

(86) PCT No.: PCT/KR2010/008226

§ 371 (c)(1),
(2), (4) Date: May 9, 2012

(87) PCT Pub. No.: WO2011/065706

PCT Pub. Date: Jun. 3, 2011

(65) Prior Publication Data

US 2012/0229359 A1 Sep. 13, 2012

(30) Foreign Application Priority Data

Nov. 24, 2009 (KR) ..... 10-2009-0114142

(51) Int. Cl.

| | |
|---|---|
| ***H01Q 3/32*** | (2006.01) |
| ***H01Q 21/00*** | (2006.01) |
| ***H01Q 21/08*** | (2006.01) |

(52) U.S. Cl.
CPC ..... *H01Q 21/0037* (2013.01); *H01Q 3/32* (2013.01); *H01Q 21/08* (2013.01)

(58) Field of Classification Search
USPC ..... 333/156, 161, 159; 342/375
See application file for complete search history.

(56) References Cited

U.S. PATENT DOCUMENTS

| | | | | |
|---|---|---|---|---|
| 7,224,246 | B2 * | 5/2007 | Thomas | 333/159 |
| 7,253,782 | B2 * | 8/2007 | Davies | 343/757 |
| 2003/0016097 | A1 | 1/2003 | McKinzie, III et al. | |
| 2005/0093737 | A1 | 5/2005 | Schoebel | |

FOREIGN PATENT DOCUMENTS

| | | | | |
|---|---|---|---|---|
| CN | 101019274 A | | 8/2007 | |
| JP | 2001237605 | * | 8/2001 | H01P 1/18 |
| JP | 2001237605 A | | 8/2001 | |
| JP | 2009147442 A | | 7/2009 | |
| WO | 2005091428 A1 | | 9/2005 | |

* cited by examiner

*Primary Examiner* — Robert Karacsony
(74) *Attorney, Agent, or Firm* — TechLaw LLP

(57) ABSTRACT

A feeding system for feeding power using slow wave structure is disclosed. The feeding system includes a first substrate, a first pattern disposed on the first substrate, being a conductor, a second substrate separated from the first substrate, and a second pattern configured to locate on the second substrate, being a conductor. Here, the first pattern and the second pattern are connected electrically, and at least one of the first pattern and the second pattern has a slow wave structure.

8 Claims, 8 Drawing Sheets

(A)

(B)

N PORT FEEDING SYSTEM USING A SLOW WAVE STRUCTURE FEEDING DEVICE INCLUDED IN THE SAME

TECHNICAL FIELD

Example embodiment of the present invention relates to a feeding system and a feeding device included in the same, more particularly relates to a feeding system for distributing input power to N ports using a slow wave structure and a feeding device included in the same.

RELATED ART

A feeding system feeds power inputted from an external source to other device, e.g. radiators through an output terminal, and may be for example a phase shifter employed in an antenna shown in following FIG. 1.

FIG. 1 is a view illustrating a common antenna.

In FIG. 1, the antenna includes a reflection plate 100, phase shifters 102 formed on one surface of the reflection plate 100 and radiators 104 formed on the other surface of the reflection plate 100.

The phase shifter 102 changes phase of power (RF signal) delivered to corresponding radiators 104, thereby adjusting angle of a beam outputted from the radiators 104, i.e. tilting angle.

Generally, three radiators 104 are connected to one phase shifter 102, and thus five phase shifters are required so as to supply power to fifteen radiators 104, i.e. realize fifteen ports. As a result, five phase shifters must be formed in serial on one surface of the reflection plate 100, and so this increases size of the antenna.

The feeding system controls individually the phase shifters 102, and thus it is not easy to control to realize desired tilting angle and is inconvenient to control the phase shifters 102.

DISCLOSURE

Technical Problem

Example embodiments of the present invention provide an N port feeding system for reducing size of an antenna and usable conveniently and a feeding device included in the same.

Technical Solution

In one aspect, the prevent invention provides a feeding system comprising: a first substrate; a first pattern disposed on the first substrate, being a conductor; a second substrate separated from the first substrate; and a second pattern configured to locate on the second substrate, being a conductor. Here, the first pattern and the second pattern are connected electrically, and at least one of the first pattern and the second pattern has a slow wave structure.

In another aspect, the present invention provides a feeding device comprising: a first substrate; and a first pattern disposed on the first substrate, and configured to have a slow wave structure. Here, the first pattern is connected electrically to a second pattern disposed on a second substrate separated from the first substrate.

In still another aspect, the present invention provides a feeding device comprising: a second substrate separated from a first substrate on which a first pattern and a third pattern separated electrically from the first pattern are disposed; and a second pattern disposed on the second substrate with reverse '⊂' shape. Here, a part of the second pattern is connected electrically to the first pattern, and another part of the second pattern is connected electrically to the third pattern.

In still another aspect, the present invention provides a feeding system comprising: a first substrate; a first pattern disposed on the first substrate, being a conductor; a second pattern facing to the first pattern on the first substrate, being a conductor; an input pattern separated from the first pattern and the second pattern on the first substrate; a first feeding pattern divided from the input pattern, and configured to correspond to the first pattern; and a second feeding pattern divided from the input pattern, and configured to correspond to the second pattern.

Advantageous Effects

A feeding system of the present invention distributes an input power to N ports, e.g. fifteen ports through a method of connecting electrically first patterns disposed in sequence with a slow wave structure to a third pattern having straight line shape using second patterns, and thus size of an antenna using it may reduce.

Additionally, only one feeding system can control many ports, i.e. multi ports can be realized by controlling only one feeding system, and so user's convenience may be enhanced.

Furthermore, since the feeding system delays or distributes the input power, it may be used as various devices such as a phase shifter, a power divider, a delay device, etc.

BRIEF DESCRIPTION OF DRAWINGS

Example embodiments of the present invention will become more apparent by describing in detail example embodiments of the present invention with reference to the accompanying drawings, in which.

DETAILED DESCRIPTION

Hereinafter, embodiments of the present invention will be described in detail with reference to accompanying drawings.

Figure 1:
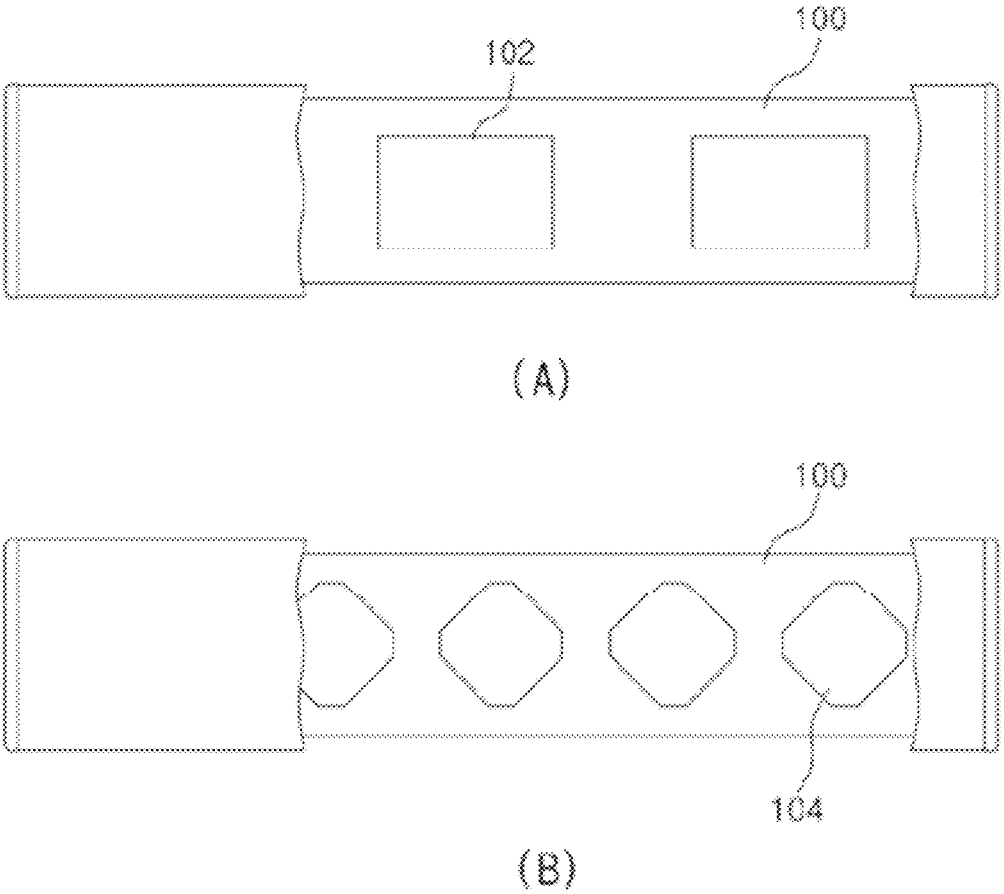
FIG. 1 Related art
FIG. 1 is a view illustrating a common antenna.
Figure 2:
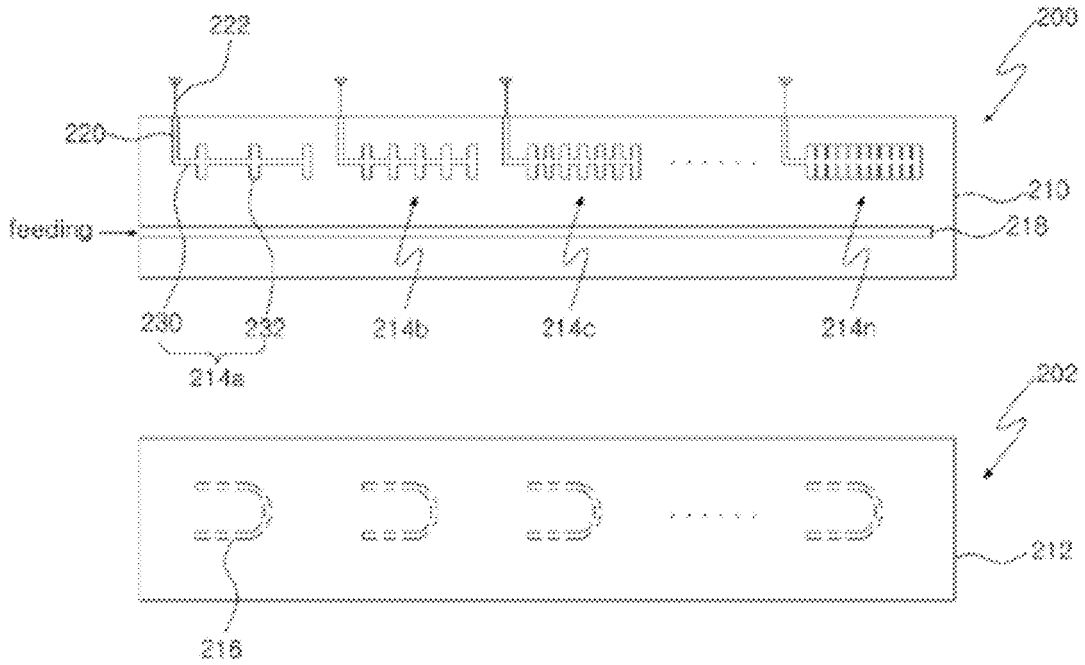
FIG. 2 is a view illustrating a feeding system according to a first embodiment of the present invention.
Figure 3:
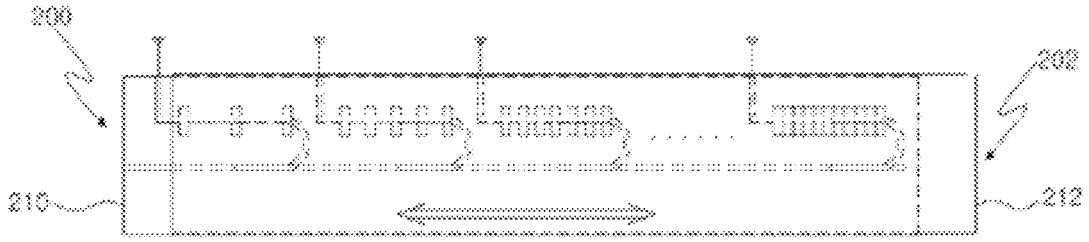
FIG. 3 is a view illustrating operation of the feeding system in FIG. 2.

FIG. 2 is a view illustrating a feeding system according to a first embodiment of the present invention, and FIG. 3 is a view illustrating operation of the feeding system in FIG. 2.

The feeding system of the present embodiment includes every device for distributing input power or providing the input power to another device through an output terminal, and may be for example a phase shifter, a power divider, a delay device and so on.

Hereinafter, structure and operation of the feeding system will be described in detail through the phase shifter.

In FIG. 2, the feeding system includes a feeding device 200 and a second feeding device 202 separated each other.

The first feeding device 200 includes a first dielectric substrate 210, at least one first pattern 214, a third pattern 218 and at least one fourth pattern 220. In another embodiment of the present invention, the first feeding device 200 may include further coupling prevention elements locating between the first patterns 214 to prevent coupling between the first patterns 214, and the coupling prevention elements are not shown.

The second feeding device 202 includes a second dielectric substrate 212 and at least one second pattern 216.

The first dielectric substrate 210 is disposed on one surface of a reflector (not shown) in case that the feeding system is employed in an antenna, and is made up of dielectric material having certain dielectric constant. A ground plate is formed on a rear surface of the first dielectric substrate 210 as described below.

The first pattern 214 is a conductor, and is embodied with a slow wave structure as shown in FIG. 2. Particularly, the first pattern 214 has a base pattern 230 and at least one projection element 232 projected from the base pattern 230, preferably plural projection elements 232.

In one embodiment of the present invention, some of the first patterns 214*a* to 214*n* may have different electrical length from the other first patterns. In one of various methods of realizing difference of electrical length, the number of the projection elements 232 in a part of the first patterns 214*a* to 214*n* may be different from that of the projection elements 232 in the other first pattern. As a result, a part of phases of RF signals provided to the radiators 222 through the first patterns 214*a* to 214*n* may be different. This will be described below.

Every first pattern 214*a* to 214*n* may have the same number of projection elements 232. However, it is desirable that the number of the projection elements 232 in a part of the first patterns 214*a* to 214*n* is different from that of the projection elements 232 in the other first pattern when characteristics of the antenna.

In another embodiment of the present invention, in the projection elements 232 of the first pattern 214, the number of the projection elements 232 located on an upper side may be different from that of the projection elements located on a lower side.

Referring to shape of the projection elements 232, the projection elements 232 in FIG. 2 have the rectangular shape, but the projection elements 232 may have various shapes such as triangle shape, curve shape, etc.

The third pattern 218 is disposed on the first dielectric substrate 200 with for example straight line shape, and is embodied with for example a' length adequate to cover every first pattern 214.

In addition, the third pattern 218 functions as an input terminal. That is, power (RF signal) is inputted through one end of the third pattern 218, i.e. inputted through left end of the third pattern 218, and the inputted power is delivered to the first patterns 214 through the second patterns 216 as described below.

The fourth pattern 220 is a conductor, and connects electrically the first pattern 214 to an output terminal device, e.g. the radiator 222. As a result, the power inputted through the third pattern 218 is delivered to the radiator 222 through the second pattern 216, the first pattern 214 and the fourth pattern 220, and thus specific radiation pattern is outputted from the radiator 222.

In one embodiment of the present invention, a part or all of phases of RF signals transmitted through the fourth patterns 220 may be different. Preferably, the phases may be formed according to specific rule when operation of the antenna is considered, and they may be changed with constant pattern as described below when the tilting angle is adjusted.

Every fourth pattern 220 has the same shape and size (width and length) in FIG. 2, but shape or size of a part of the fourth patterns 220 may be different from that of the other fourth pattern 220 according to for example a power distributing method. As a result, impedance of a part of the fourth patterns 220 may be different from that of the other fourth pattern 220.

The second dielectric substrate 212 is made up of dielectric material having certain dielectric constant, and may have the same dielectric constant as the first dielectric substrate 210 or have different dielectric constant from the first dielectric substrate 210.

The second patterns 216 are conductors, are for example disposed regularly on the second dielectric substrate 212, and have the number corresponding to the first patterns 214.

The second patterns 216 connect electrically the third pattern 218 to the first patterns 214. Particularly, a part of the second pattern 216, i.e. left part of the second pattern 216 in FIG. 2 is connected electrically to the third pattern 218, and the other part of the second pattern 216, i.e. right part of the second pattern 216 in FIG. 2 is connected electrically to corresponding first pattern 214. As a result, the power inputted through the third pattern 218 is delivered to the first pattern 214 through the second pattern 216.

In one embodiment of the present invention, the second pattern 216 connects electrically the first pattern 214 to the third pattern 218 through electrical coupling, and it may have reverse "⊂" shape. However, shape of the second pattern 216 is not limited as long as the second pattern 216 connects electrically the first pattern 214 to the third pattern 218.

Every second pattern 216 has the same shape and size in FIG. 2, but a part of the second patterns 216 may have different shape or size.

In brief, the first patterns 214*a* to 214*n* and the third pattern 218 separated with one another are formed on the first dielectric substrate 210, and the second patterns 216 are formed on the second dielectric substrate 212. In case that the second dielectric substrate 212 locates on the first dielectric substrate 210 as shown in FIG. 3, the second patterns 216 connect electrically the first patterns 214 to the third pattern 218 through electrical coupling. As a result, certain radiation pattern is outputted from the radiators 222.

In case of changing direction of radiation pattern outputted from the radiators 222, i.e. changing the tilting angle in the feeding system, phase of the RF signal provided to the radiators 222 should be changed. This may be realized by moving left and right the second dielectric substrate 212 on the first dielectric substrate 210 as shown in FIG. 3 under the condition that the first dielectric substrate 210 is fixed. In another embodiment of the present invention, under the condition that the second dielectric substrate 212 is fixed, the first dielectric substrate 210 may move left and right.

Hereinafter, a process of changing phase in the feeding system will be described in detail with reference to accompanying drawings.

Figure 4:
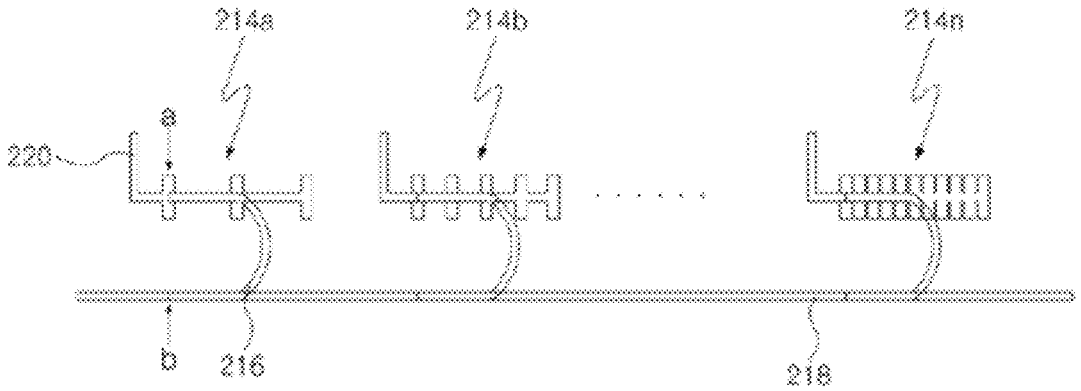
FIG. 4 is a view illustrating operation of the feeding system according to one embodiment of the present invention.
Figure 4:
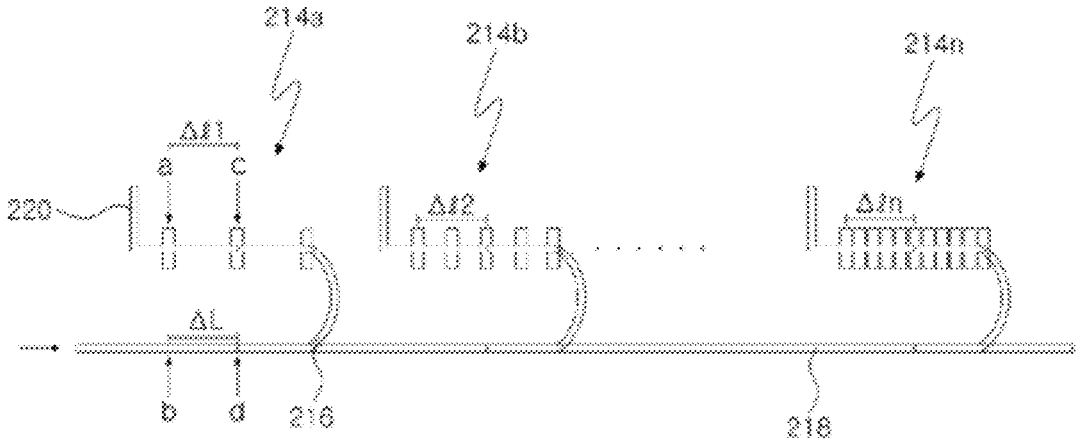
Figure 5:
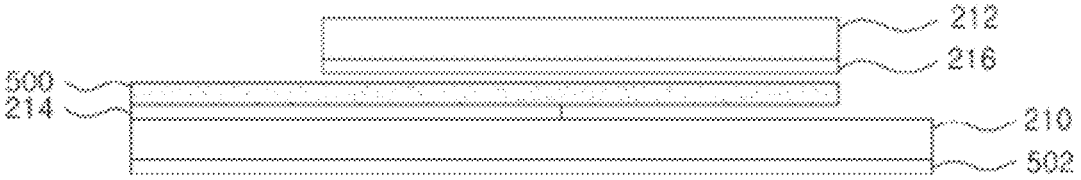
FIG. 5 is a view illustrating schematically the structure of the feeding system when the second dielectric substrate locates on the first dielectric substrate according to one embodiment of the present invention.

FIG. 4 is a view illustrating operation of the feeding system according to one embodiment of the present invention, and FIG. 5 is a view illustrating schematically the structure of the feeding system when the second dielectric substrate locates on the first dielectric substrate according to one embodiment of the present invention.

When the second feeding device 202 locates on the first feeding device 200, a part of the second pattern 216 overlaps with corresponding first pattern 214 and other part of the second pattern 216 overlaps with the third pattern 218 as shown in FIG. 4(A) and FIG. 5. As a result, the first patterns 214 and the third pattern 218 are connected electrically through the second patterns 216.

In case that the second feeding device 202 shifts in the right direction as shown in FIG. 4(B), overlap section of the first pattern 214 and the second pattern 216 and overlap section of the third pattern 218 and the second pattern 216 are changed. For example, in case that one end part of the second pattern 216 shifts from a point to c point and another end of the second pattern 216 shifts from b point to d point, electrical lengths between the first patterns 214 and corresponding second patterns 216 are changed by Δl1, Δl2, Δl3, . . . Δln, respectively, and every electrical length between the third pattern 218 and corresponding second patterns 216 is changed by Δ L. Accordingly, phase ϕ of the power (RF signal) outputted to the fourth pattern 220 is changed as shown in following Equation 1.

$$\Delta\varphi = (\Delta lN + \Delta L)\cdot\frac{2\pi}{\lambda_g}, \qquad \text{[Equation 1]}$$

where N=1, 2, . . . , n, and λ g means wavelength of the RF signal.

Referring to Equation 1, phase ϕ is changed in proportion to sum of ΔlN and ΔL.

Hereinafter, phase change of the RF signals outputted to the radiators 222 in FIG. 4 will be described. Here, ΔL is not considered.

In case that the second patterns 216 shift as shown in FIG. 4(B), phase of a first RF signal transmitted to a radiator 222-1 through the first pattern 214*a* and corresponding fourth pattern 220-1 changes in proportion to electrical length Δl1, and phase of a second RF signal transmitted to a radiator 222-2 through the first pattern 214*b* and corresponding fourth pattern 220-2 changes in proportion to electrical length Δl2. Additionally, phase of a nth RF signal transmitted to a radiator 222-n through the first pattern 214*n* and corresponding fourth pattern 220-n changes in proportion to electrical length Δln Referring to the first patterns 214 in FIG. 4(B), the number of the projection elements 232 increases in the right direction, and thus electrical length corresponding to the first pattern 214 in the right direction more increases. Accordingly, phase of the RF signal transmitted to corresponding radiator 222 through the first pattern 214 in the right direction may change more.

In one embodiment of the present invention, phases of the RF signals may change in serial by Δϕ, Δ2ϕ, . . . , Δnϕ in the right direction.

If the first patterns 214 have different structure, phases of RF signals may change more in the left direction.

In above description, ΔL is not considered. However, ΔL as well as Δln should be considered to design the feeding system when desired phases of RF signals are determined. However, since ΔL affects little to phase change of the RF signal, the feeding system may be designed considering only Δln except ΔL.

In short, the feeding system of the present embodiment changes phases of the RF signals inputted to the radiators 222 through a method of moving left and right the second feeding device 202 on the first feeding device 200. That is, the feeding system operates as the phase shifter.

In another aspect, if the fourth patterns 220 function as output ports for other devices, power inputted to the third pattern 218 is delivered to the devices connected electrically to the output ports through the fourth patterns 220. In other words, the feeding system may operate as a power divider.

In another aspect, the RF signal transmitted to the radiator 222 is delayed according as the second pattern 216 shifts in the right direction when one overlapped pattern is considered. That is, the feeding system may operate as a delay device.

Hereinafter, the feeding system will be described with reference to sectional structure shown in FIG. 5, and FIG. 5 shows a sectional view when the second feeding device 202 locates on the first feeding device 200.

Referring to FIG. 5, the first pattern 214 is formed on the first dielectric substrate 210, and the second pattern 216 is formed on the second dielectric substrate 212. A ground plate 502 is also formed on a rear surface of the first dielectric substrate 210.

In one embodiment of the present invention, a dielectric layer 500 having certain dielectric constant may locate between the first pattern 214 and the second pattern 216. For example, the dielectric layer 500 is formed on the first patterns 214 and it is used to reduce PIMD (Passive Intermodulation Distortion) or prevent corrosion.

The dielectric layer 500 may locate also between the third pattern 218 and the second pattern 216, but it is not shown.

Figure 6:
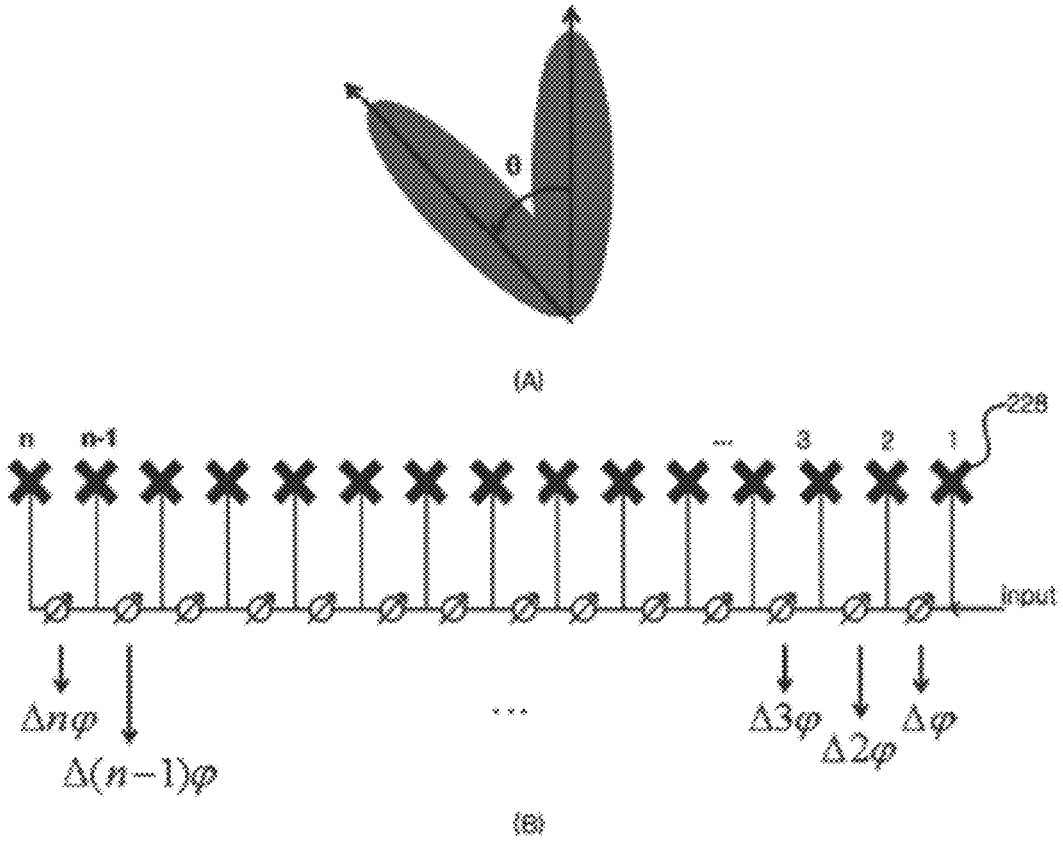
FIG. 6 is a view illustrating a process of adjusting phase in the feeding system according to one embodiment of the present invention.

FIG. 6 is a view illustrating a process of adjusting phase in the feeding system according to one embodiment of the present invention. It is assumed that ΔL does not affect to phase of corresponding RF signal and the projection elements 232 are set to change constantly electrical length between the first pattern 214 and the second pattern 216 by ΔlN in the right direction in FIG. 4. In other words, Δl2=2×Δl1, Δl3=3×Δl1, . . . , Δln=n×Δl.

In FIG. 6, for example n (integer of above 2) first patterns 214 may be formed on the first dielectric substrate 210, and the first patterns 214 may be connected electrically to n radiators 222.

In case that overlap areas of the first patterns 214 and the second patterns 216, overlap areas of the third pattern 218 and the second patterns 216 change according to movement of the second feeding device 202, a part of power applied through the input terminal (left end of the third pattern 218) is provided to a first radiator 222-1 through the second pattern 216 and the first pattern 214*a* locating at the first section, the other power is delivered to a second section through the third pattern 218. In this case, phase of the RF signal transmitted to the first radiator 222-1 through the first pattern 214*a* changes by Δϕ due to change of electrical length of Δl1.

A part of power delivered through the third pattern 218 from the first section is provided to the second radiator 222-2 through the second pattern 216 and the first pattern 214*b* locating at the second section, and the other power is delivered to a third section through the third pattern 218. In this case, phase of the RF signal transmitted to the second radiator 222-2 through the first pattern 214*b* changes by Δ2ϕ due to change of electrical length of (2×Δl1).

That is, RF signals having phases changing in order by Δϕ, Δ2ϕ, . . . , Δnϕ may be provided to corresponding radiators 222 as shown in FIG. 6, and thus tilting angle of a beam may be adjusted by θ.

In brief, the feeding system of the present embodiment changes phases of corresponding RF signals using the number of the projection elements 232 formed to the first patterns 214, thereby realizing desired tilting angle.

In the conventional antenna, many phase shifters are required for realizing multi ports, i.e. feeding power to radiators. However, since one feeding system realizes multi ports, size of an antenna using the feeding system may reduce.

The conventional antenna adjusts tilting angle by controlling individually the phase shifters, and so it is inconvenient. However, the phase shifter of the present invention may adjust the tilting angle by simple operation of moving the second feeding device 202, and thus it is convenient.

In above description, the projection elements 232 formed to the first patterns 214 have the same size, but some of the projection elements 232 may have different size as described below. Furthermore, the projection elements 232 have rectangular shape, but they may have various shapes such as elliptical shape, etc.

In above description, the feeding system realizes electrical length difference, i.e. phase difference by using the number of the projection elements 232 formed to the first patterns 214, but it may realize the electrical length difference by setting differently size of the projection elements 232 under the condition that the number of the projection elements 232 formed to the first patterns 214 is the same.

In other words, the structure (size, shape and so on) of the first patterns 214 may be variously modified as long as the first patterns 214 change corresponding RF signal to have desired phase with the slow wave structure.

Figure 7:
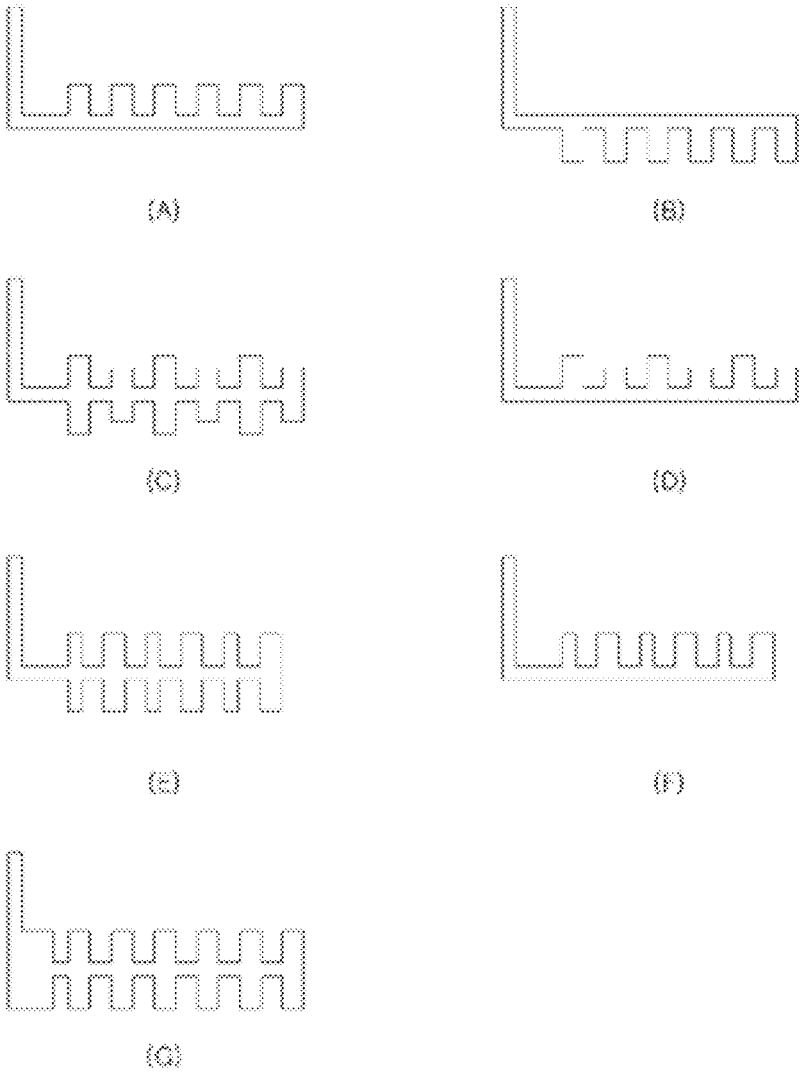
FIG. 7 is a view illustrating schematically various structures of first patterns according to another embodiment of the present invention.

FIG. 7 is a view illustrating schematically various structures of first patterns according to another embodiment of the present invention.

In FIG. 7(A) and FIG. 7(B), projection elements are projected from a base pattern in one direction unlike those in FIG. 2 where the projection elements 232 are projected from the base pattern230 in both of directions.

Referring to FIG. 7(C) and FIG. 7(D), a part of projection elements may have different length from the other projection elements.

In FIG. 7(E) and FIG. 7(F), width of a part of projection elements may be different from that of the other projection elements.

In FIG. 7(G), a base pattern may be different from that in FIG. 7(A) to FIG. 7(F). That is, width of a part connected to the fourth pattern of the base pattern may be greater than that of a part to which projection elements are formed.

In other words, the structure of the first pattern may be variously modified as long as the first pattern has the slow wave structure.

Figure 8:
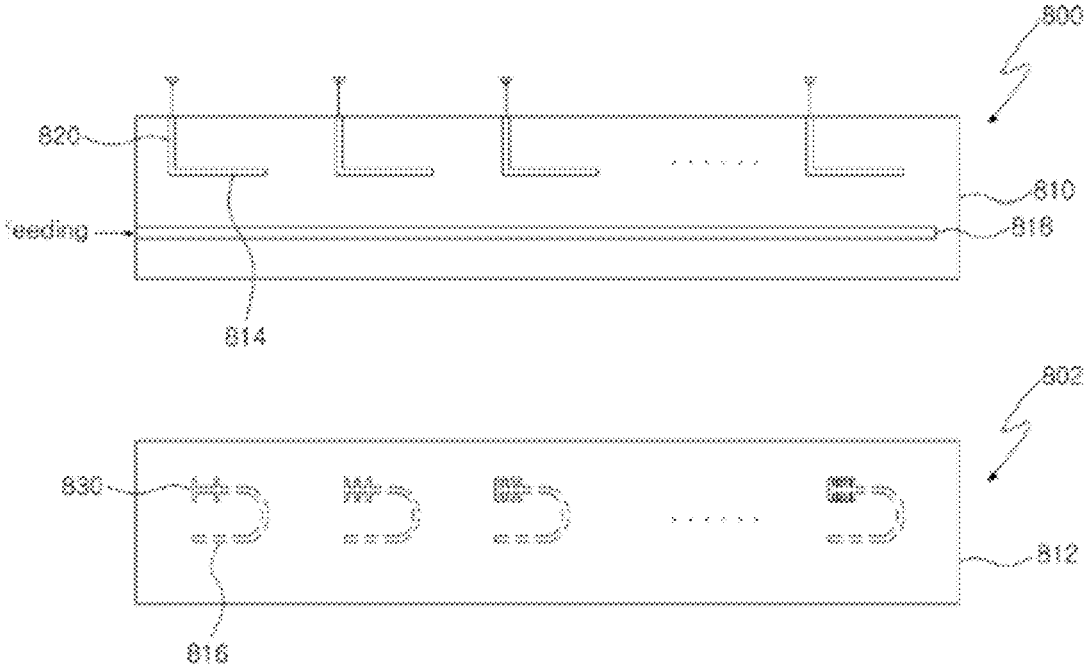
FIG. 8 is a view illustrating a feeding system according to a second embodiment of the present invention.

FIG. 8 is a view illustrating a feeding system according to a second embodiment of the present invention.

In FIG. 8, the feeding system of the present embodiment includes a first feeding device 800 and a second feeding device 802.

The feeding device 800 includes a first dielectric substrate 810, at least one first pattern 814, a third pattern 818 and one or more fourth pattern 820.

The second feeding device 802 includes a second dielectric substrate 812 and at least one second pattern 816.

Since the other elements except the first patterns 814 and the second patterns 816 are the same as in the first embodiment, any further description concerning the same elements will be omitted.

The first pattern 814 has the straight line shape. That is, the slow wave structure is not formed to the first pattern 814 in the present embodiment unlike the first embodiment where the slow wave structure is formed.

The second pattern 816 has reverse "⊂" shape, a part of the second pattern 816 is connected electrically to corresponding first pattern 814, and another part of the second pattern 816 is connected electrically to the third pattern 818. Unlike the first embodiment, slow wave structure 830 is formed to the second pattern 816 as shown in FIG. 8. In other words, at least one projection element for the slow wave structure 830 is formed to a part of the second pattern 816 as shown in FIG. 8.

In one embodiment of the present invention, slow wave structure may be formed at a part overlapped with the first pattern 814 of the second pattern 816 as shown in FIG. 8.

In another embodiment of the present invention, slow wave structure may be formed to a part overlapping with the third pattern 818 of the second pattern 816, which is not shown.

That is, in the present embodiment unlike the first embodiment where the slow wave structure for delaying phase is formed to the first pattern, the slow wave structure is formed to the second pattern 816. Since operation of the feeding system in the present invention is similar to that in the first embodiment, any further description concerning operation of the feeding system will be omitted.

Referring to the first embodiment and the second embodiment, the feeding system of the present invention connects electrically the first patterns to the third pattern through which power is inputted using the second patterns, and moves left and right the first feeding device or the second feeding device to change phase. Specially, the slow wave structure is formed to the first pattern or the second pattern. The slow wave structure may be formed to both of the first pattern and the second pattern.

That is, the structure of the feeding system of the present invention may be variously modified as long as the slow wave structure is formed to some of patterns and the second pattern connects electrically the first pattern to the third pattern.

Figure 9:
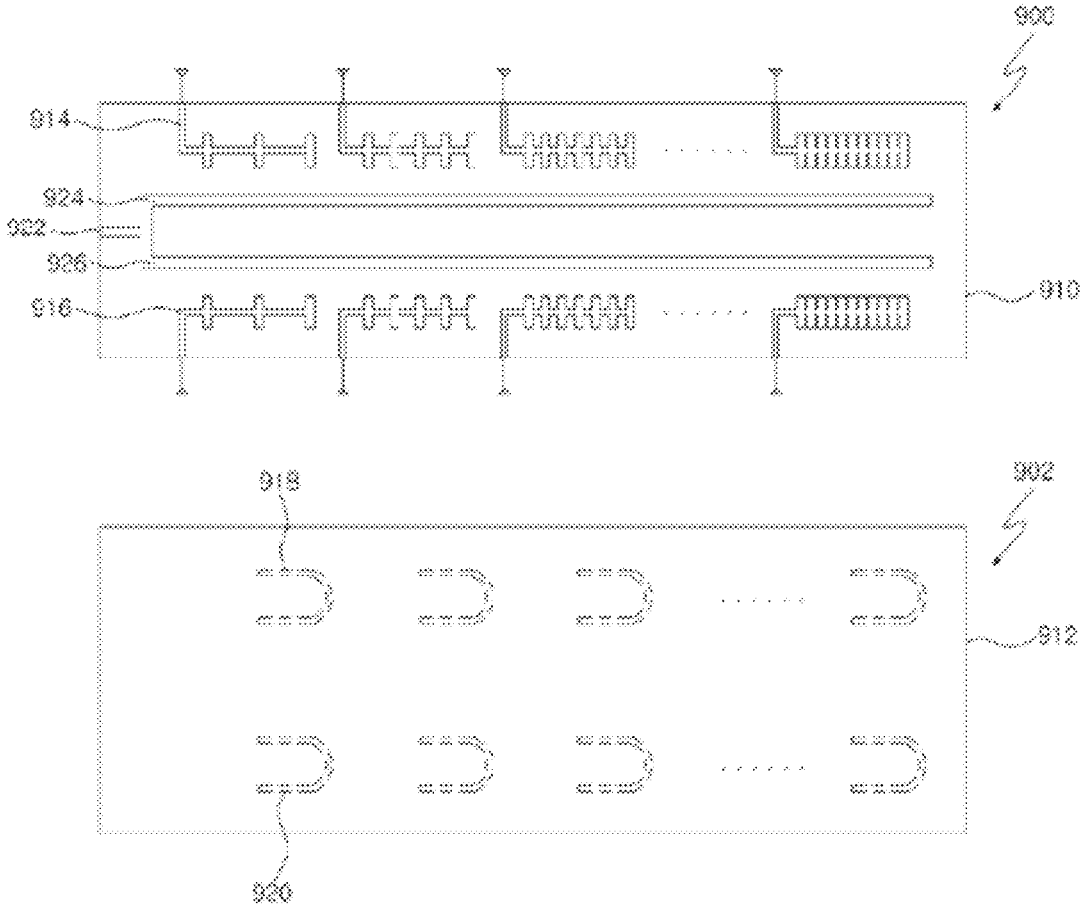
FIG. 9 is a view illustrating a feeding system according to a third embodiment of the present invention.

FIG. 9 is a view illustrating a feeding system according to a third embodiment of the present invention.

In FIG. 9, the feeding system of the present embodiment includes a first feeding device 900 and a second feeding device 902.

The first feeding device 900 includes a first dielectric substrate 910, at least one first pattern 914, one or more second pattern 916, an input pattern 922, a first feeding pattern 924 and a second feeding pattern 926.

The second feeding device 902 includes a second feeding substrate 912, at least one third pattern 918 and one or more fourth pattern 920.

Unlike the first embodiment and the second embodiment, the patterns 914 and 916 locate on both sides of one surface of the first dielectric substrate 910, and each of the patterns 914 and 916 is connected electrically to corresponding radiator. In other words, if ten first patterns are disposed in sequence in the first embodiment and the second embodiment, five patterns in the present embodiment may be disposed in sequence on an upper part of the surface of the first dielectric substrate 910 and the other five patterns may be disposed in sequence on a lower part of the surface of the first dielectric substrate 910. As a result, total length of the feeding system of the present embodiment may be smaller than that of the feeding system in the first embodiment and the second embodiment. Furthermore, length of cables (not shown) for connecting the fourth patterns 914 to corresponding radiators 222 may become shorter when impedance matching is considered.

In brief, the feeding system in the first embodiment and the second embodiment is embodied in one area, but the feeding system of the present embodiment is embodied in two areas. Here, the area means area in which the patterns locate in the horizontal direction.

The feeding patterns 924 and 926 and the patterns 918 and 920 are formed according to the two areas. Particularly, the third patterns 918 connects electrically the first patterns 914 to the first feeding pattern 924, and the fourth patterns 920 connects electrically the second patterns 916 to the second feeding pattern 926.

In one embodiment of the present invention, the feeding patterns 924 and 926 are divided from the input pattern 922. Accordingly, power inputted through the input pattern is divided into the feeding patterns 924 and 926. The feeding patterns 924 and 926 may have the same width or different width.

In short, the feeding system of the present invention disposes the patterns of the first feeding device in plural areas, and uses plural feeding patterns to feed the power to the patterns in the areas.

The patterns locate in two areas in above description, but they may locate in three or more areas. The feeding system should have plural distribution structure (including input pattern and feeding patterns) as shown in FIG. 9, and the distribution structures form one distribution network. It is desirable that power is inputted from an outer source through one cable, etc. and the inputted power is distributed to the patterns in the areas when complexity of the feeding system is considered.

In another embodiment of the present invention, a first feeding pattern may be disposed on an upper part of the first dielectric substrate and a second feeding pattern may locate on a lower part of the first dielectric substrate under the condition that first patterns and second patterns locate at a central area of the first dielectric substrate.

In still another embodiment of the present invention, a first feeding pattern may locate on an upper part of the first dielectric substrate, first patterns may be disposed below the first feeding pattern on the first dielectric substrate, a second feeding pattern may locate on a lower part of the first dielectric substrate, and second patterns may be disposed below the second feeding pattern on the first dielectric substrate.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A feeding system comprising:

a first substrate;

plurality of first patterns disposed on the first substrate, the plurality of first patterns being conductor;

a second substrate separated from the first substrate; and a plurality of second patterns disposed on the second substrate, the plurality of second patterns being conductors, the plurality of second patterns having a reverse '⊂' shape, a third pattern disposed on the first substrate and formed as a straight line, the third pattern being a conductor, the plurality of first patterns being disposed in parallel to the third pattern;

wherein the plurality of first patterns and the plurality of second patterns are connected electrically, at least some of the plurality of first patterns and the plurality of second patterns form a slow wave structure, at least one of the plurality of first patterns and the plurality of second patterns includes at least one projection element, at least one of the first patterns having a different number of projection elements from others of the plurality of first patterns or at least one of the projection elements having a different size from others of the projection elements, and at least one of the plurality of second patterns has one end part thereof electrically connected to one of the plurality of first patterns and has another end part thereof electrically connected to the third pattern.

2. The feeding system of claim 1, wherein the plurality of first patterns are disposed in parallel to the third pattern to form a slow wave structure, and at least one of the plurality of first patterns is connected electrically to a radiator through a fourth pattern.

3. The feeding system of claim 1, wherein the plurality of first patterns and the plurality of second patterns are connected electrically through electrical coupling, and the third pattern and the plurality of second patterns are connected electrically through electrical coupling.

4. The feeding system of claim 1, wherein each of the plurality of first patterns includes a first base pattern shaped as a straight line with at least one projection element projecting from the first base pattern.

5. The feeding system of claim 1, at least some of the plurality of second patterns form a slow wave structure.

6. The feeding system of claim 1, wherein a dielectric layer having a certain dielectric constant is located between the plurality of first and the plurality of second patterns.

7. The feeding system of claim 1, wherein the feeding system is a phase shifter.

8. A feeding system comprising:

a first substrate;

a plurality of first patterns disposed on the first substrate;

a plurality of second patterns disposed on the first substrate and facing the plurality of first patterns an input pattern separated from the plurality of first patterns and the plurality of second patterns, the input pattern disposed on the first substrate;

a first feeding pattern divided from the input pattern, the first feeding pattern positioned adjacent to the plurality of first patterns; and a second feeding pattern divided from the input pattern, the second feeding pattern positioned adjacent to the plurality of second patterns, a second substrate separated from the first substrate;

a plurality of third patterns disposed on the second substrate and configured to electrically connect the plurality of first patterns to the first feeding pattern; and a plurality of fourth patterns disposed on the second substrate and configured to electrically connect the plurality of second patterns to the second feeding pattern;

wherein one or more of the plurality of first patterns, the plurality of second patterns, the plurality of third patterns and the plurality of fourth patterns form a slow wave structure, the plurality of first patterns are disposed in parallel to the first feeding pattern to form a slow wave structure, the plurality of second patterns are disposed in parallel to the second feeding pattern to form a slow wave structure, and the plurality of third patterns and the plurality of fourth patterns have a reverse '⊂' shape, the plurality of first patterns, the plurality of second patterns, the plurality of third patterns, the plurality of fourth patterns, the input pattern, the first feeding pattern, and the second feeding pattern are conductors, each of the plurality of first patterns and the plurality of second patterns includes a first base pattern shaped as a straight line, at least one projection element projects from the first base pattern, and at least one of the plurality of first patterns and the plurality of second patterns has a different number of projection elements from others of the plurality of first patterns and the plurality of second patterns.

* * * * *